United States Patent [19]

Kuethe

[11] Patent Number: 5,067,304

[45] Date of Patent: Nov. 26, 1991

[54] PACKAGING WITH UTENSIL

[75] Inventor: David F. Kuethe, Madison, Wis.

[73] Assignee: Oscar Mayer Foods Corporation, Madison, Wis.

[21] Appl. No.: 653,914

[22] Filed: Feb. 12, 1991

[51] Int. Cl.[5] ..... B65B 61/00

[52] U.S. Cl. ..... 53/410; 53/74; 53/133.1; 53/252; 53/566

[58] Field of Search ..... 53/410, 412, 133.1, 53/566, 564, 458, 457, 468, 474, 473, 252, 251, 250, 249, 493, 74, 500, 498, 173, 170

[56] References Cited

U.S. PATENT DOCUMENTS

| | | | |
|---|---|---|---|
| 3,269,091 | 8/1966 | Martin | 53/566 X |
| 4,211,054 | 7/1980 | Sramek | 53/566 X |
| 4,572,758 | 2/1986 | Wild | 53/410 X |
| 4,660,353 | 4/1987 | Greenwell | 53/133.1 X |
| 4,707,965 | 11/1987 | Becker | 53/410 |
| 4,903,458 | 2/1990 | Hakansson | 53/410 |
| 4,969,308 | 11/1990 | Hakansson | 53/133.1 X |

*Primary Examiner*—James F. Coan

*Attorney, Agent, or Firm*—Joseph T. Harcarik

[57] ABSTRACT

A continuous and automatic system and method for packing a container with a utensil applied thereto in a carton forms a finished package. Initially, the containers travel along an infeed conveyor and are transferred by a transferring device to flighted belt. The transferring device includes a first sensor for sensing the presence of a backlog of the containers at the transferring device and for enabling the transferring device when the backlog is sensed. After being placed on the flighted belt, the containers have a respective wrapped utensil applied thereto. The applying device includes a second sensor which senses a presence of each successive container. A feedback device is also used for matching a selected line speed of the containers on the flighted belt with a transferring speed of the transferring device. Finally, each container with the utensil applied thereto is placed in a carton by a suitable cartoning device. The cartoning device also closes the carton about the container to form the finished package.

15 Claims, 1 Drawing Sheet

PACKAGING WITH UTENSIL

FIELD OF THE INVENTION

The present invention relates generally to containers with respective utensils applied thereto, and more particularly to a continuous and automatic system and method for packing containers with utensils applied thereto in cartons to form finished packages.

BACKGROUND OF THE INVENTION

The applying of a utensil to a container has been disclosed in the prior art. For example, in U.S. Pat. No. 4,707,965 (Becker), a process for attaching drinking straws to packaging containers and an apparatus for carrying out the process is disclosed. The disclosed packaging process incorporates a combination of elements, including a conveyer device for shuttling the containers and a glue/straw applicator device which applies the straws to the containers. The conveyer device employs package-sensing means to detect gaps in the production line and the glue/straw applicator device comprises a belt of individually packaged straws from which the packaged straws are cut and pressed onto the glue by suitable application means.

Another arrangement for the attachment of straws to the side of a packaging container is disclosed in U.S. Pat. No. 4,903,458 (Hakansson). The arrangement includes a glue applicator and a rotary-drum applicator.

SUMMARY OF THE INVENTION

In accordance with the present invention, a system and method for the continuous and automatic packing of containers with utensils applied thereto in cartons is provided. The containers initially travel along an infeed conveyer and are transferred to a flighted belt by a transferring means. The transferring means includes a first sensing means for sensing the presence of a backlog of containers at the transferring means and for enabling the transferring means when the backlog is sensed. As each container travels along the flighted belt, an applying means applies a respective wrapped utensil to a surface of each container. The applying means includes a second sensing means which senses a presence of each successive container on the flighted belt. A selected line speed of the containers on the flighted belt is also matched with a transferring speed of the transferring means by a suitable feedback means. Finally, a cartoning means is used for placing each successive container with the utensil applied thereto in a carton, and for closing the carton about the container to form a finished package.

In a preferred embodiment of the present invention, the infeed conveyer and flighted belt include respective portions thereof adjacent the transferring means which are parallel and laterally adjacent. In addition, the containers are rectangularly shaped in plan view. The transferring means then includes a stop against which the containers travelling along the infeed conveyer stack in a side-by-side alignment to form the backlog and a pusher member which rotates around the stop and which pushes a lead one of the containers of the backlog to the adjacent portion of the flighted belt.

The applying means of the preferred embodiment preferably includes a gluing means for successively applying an adhesive to each container sensed by the second sensing means on the flighted belt. A feeding-/cutting means then feeds a continuous row of wrapped utensils and successively cuts a leading wrapped utensil from the row. A placing receives the cut wrapped utensil and places the wrapped utensil on the adhesive of the successive containers. Preferably, the applying means includes a first one and a second one of the feeding/cutting means which are associated respectively with a first and a second one of the placing means. With this configuration, the first and second placing means place an associated wrapped utensil on alternate containers passing thereby on the flighted belt.

The cartoning means preferably includes an erecting means having a carton hopper containing flat cartons therein which erects an open carton and a third sensing means for sensing the presence of successive containers with respective utensils applied thereto on the flighted belt approaching the cartoning means. This third sensing means also actuates the erecting means to erect a carton for each successive container sensed. The cartoning means also includes a pusher means for pushing successive containers into respective successively presented erected cartons coming from the erecting means. In this embodiment, the erecting means further includes a closing means for closing opposite ends of these successive cartons containing the container and utensil applied thereto.

It is an advantage of the present invention that commercially available equipment is usable in the system and method of the present invention.

It is also an advantage of the present invention that a container with a utensil applied thereto is enclosed in a paperboard carton, continuously and automatically.

Other features and advantages of the present invention are stated in or apparent from a detailed description of a presently preferred embodiment of the invention found hereinbelow.

DETAILED DESCRIPTION OF THE PREFERRED EMBODIMENT

Figure 2:
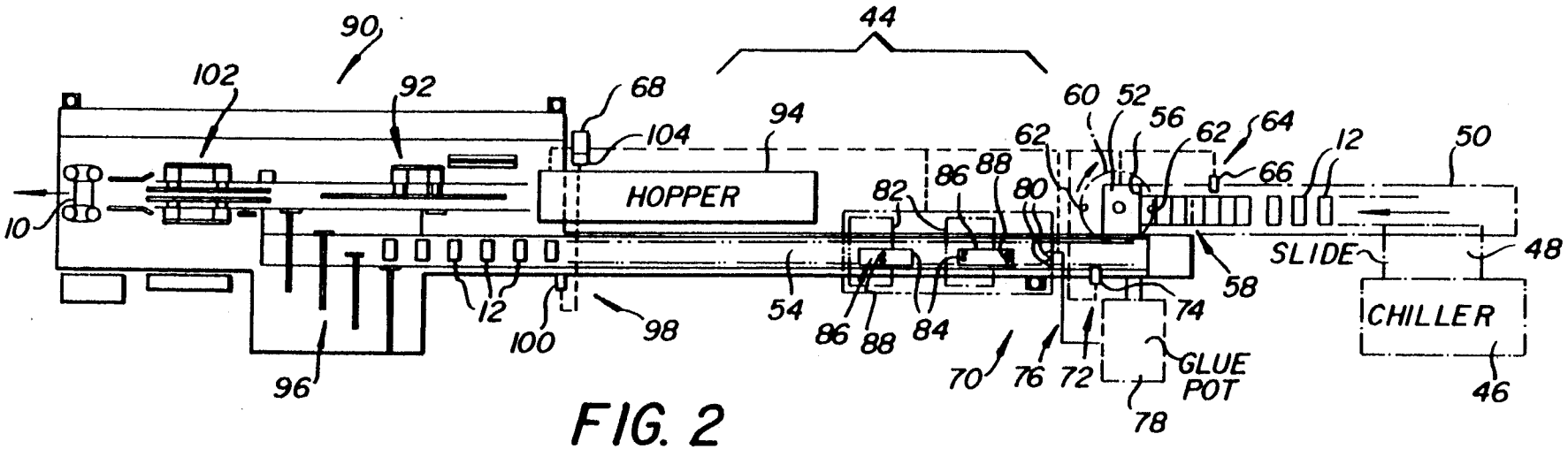
FIG. 2 is a schematic plan view of a continuous and automatic system for packing the container depicted in FIG. 1 in a carton as depicted in FIG. 1.

With reference now to the drawings in which like numerals represent like elements, it will initially be appreceiated that a finished package 10 according to the present invention includes a product container 12 which is packaged within a carton 14 typically provided with suitable indicia thereon. In this embodiment, product container 12 includes two food compartments 16 and 18 and a flexible film 20 sealingly applied about the tops of food compartments 16 and 18. Preferably, food compartments 16 and 18 and flexible film 20 are transparent so that the food products contained therein are visible to a consumer. For example, food compartment 16 could include a crab or lobster-like fish product and food compartment 18 a cocktail sauce or butter-like liquid in which the crab or lobster-like fish is dipped.

Figure 1:
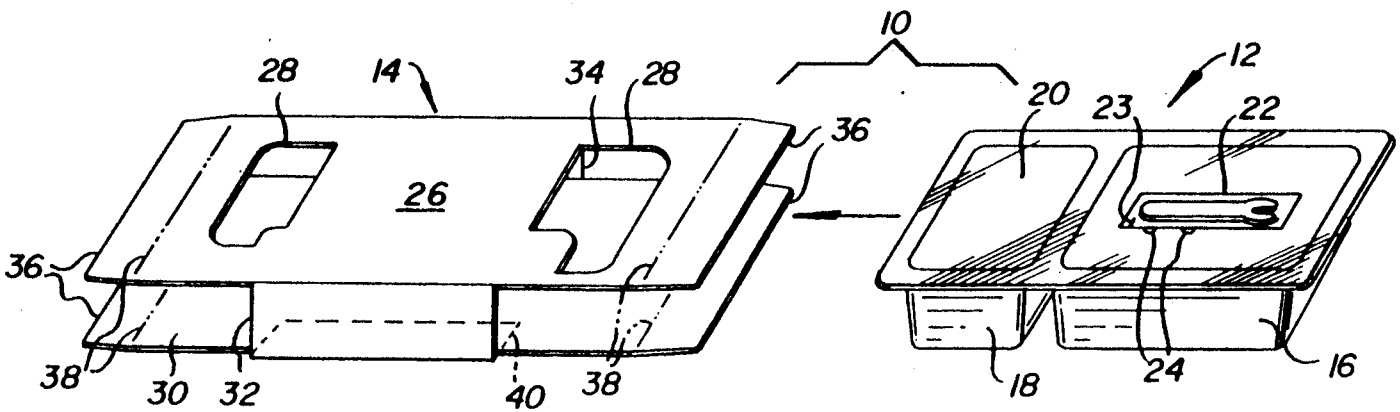
FIG. 1 is a schematic prespective view of a container with a utensil applied thereto and an associated carton in which the container is received according to the present invention.

As shown in FIG. 1, a wrapped utensil 22 is provided with product container 12. Wrapped utensil 22 can be a fork, knife or spoon or similar to one of these. In this embodiment the utensil is fork-like, and is used to dip the food contained in food compartment 16 into the liquid provided in food compartment 18. Wrapped utensil 22 is attached to flexible film 20 by two drops 24 of glue or adhesive.

Product container 12 is rectangular shaped, and is received within the similarly rectagularly shaped carton 14. Carton 14 is preferably made of cut paperboard and includes a top 26 in which two cutouts 28 have been provided. Cutouts 28 are positioned so that the food products in food compartments 16 and 18 are viewable therethrough. Carton 14 also includes a bottom 30 and sides 32 and 34. Sides 32 and 34 do not extend along the length of top 26 and bottom 30, so that the food products in a food compartments 16 and 18 are also viewable on either side of sides 32 and 34. Both top 26 and bottom 30 also include ends 36 which are designed to be bent at 90° along fold lines 38 so that adjacent ends 36 overlap and can be glued together to hold product container 12 in carton 14 and thus to form the finished package 10. It should also be appreciated that carton 14 is formed of one piece, with the distal end 40 of side 32 being glued to the underside of bottom 30 so that in the form depicted in FIG. 1 carton 14 can be pressed flat and subsequently erected to receive product container 12 as depicted in FIG. 1.

Depicted in FIG. 2 is a system 44 for continuously and automatically packing cartons 14 with product containers 12 having a wrapped utensil 22 thereon to form finished packages 10. Initially, product containers 12 which are present in a chiller 46 are caused to proceed down a slide 48 to an infeed conveyer 50. Containers 12 travel along infeed conveyer 50 in the direction shown.

At the downstream end of infeed conveyer 50 is a transferring means 52. Transferring means 52 is used for transferring containers 12 from infeed conveyer 50 to a flighted belt 54. Transferring means 52 is conveniently a Rotary Package Shuttle made by Westlund Co. of Clearwater, Fla. Transferring means 52 includes a stop 56 against which containers 12 stack in a side-by-side alignment to form a backlog 58. Transferring means 52 also includes a rotating member 60 having a pair of depending pusher members 62 which successively engage a lead one of containers 12 in backlog 58 and push the lead container from that portion of infeed conveyer 50 adjacent thereto to a parallel and laterally adjacent portion of flighted belt 54. It should be appreciated that the pressure of the remainder of containers 12 in backlog 58 on the lead container 12 helps to assure a proper transfer of the lead container 12 to flighted belt 54 by respective pusher member 62 as the lead container slides along stop 56. In order to ensure that a proper backlog 58 is present, a first sensing means 64 such as an electric eye 66 is used to sense the presence of a sufficient backlog 58 (sufficient being up to the position of electric eye 66.). When a sufficient backlog 58 is sensed, first sensing means 64 then enables transferring means 52. This controlling of transferring means 52 is accomplished by a suitable control means 68.

Once on flighted belt 54, product containers 12 are conveyed to an applying means 70 for applying a respective wrapped utensil 22 to a top surface of each container 12. Applying means 70 is conveniently a Dual Rotary Utensil Applicator also made by Westlund Co. Applying means 70 includes a second sensing means 72 in the form of an electric eye 74 for sensing the presence of each successive container 12 on flighted belt 54 in advance of a gluing means 76. Gluing means 76 includes a glue pot 78 and a pair of applicators 80 which are positioned to each drop a spot or drop 24 of glue or adhesive on the surface of container 12 as container 12 passes thereby on flighted belt 54 after sensing by second sensing means 72.

Downstream of gluing means 76, each container 12 passes a feeding/cutting means 82. Feeding/cutting means 82 is used to feed a continuous row of wrapped utensils and to successively cut a leading wrapped utensil 22 from the row. It should be appreciated that as each wrapped utensil 22 is cut from the row, a small auxiliary knife also cuts a small notch 23 in the wrapper of the utensil so that the consumer can easily tear the wrapper at this notch to remove the wrapper when it is desired to use the utensil. A placing means 84 then successively receives the cut wrapped utensil 22 and places the wrapped utensil 22 on the dual drops 24 of adhesive provided on each container 12 passing thereby.

As indicated above, applying means 70 preferably includes a Westlund Dual Rotary Utensil Applicator so that both a first one and a second one of feeding/cutting means 82 and placing means 84 are respectively associated. In this manner, the first and second placing means 84 place an associated wrapped utensil 22 on alternate containers 12 passing thereby on flighted belt 54. Placing means 84 conveniently includes rotating members 86 having three pairs of suction cups 88 thereon. It will thus be appreciated that rotating members 86 place the wrapped utensil 22 on drops 24 of the hot melt adhesive or glue provided by gluing means 76. Each wrapped utensil 22 is thus successively cut off from the row with a guillotine knife assembly, and at the same time vacuum cups 88 grap each successively cut wrapped utensil 22 and rotate downward. This dual rotary mechanism ensures utensil registration and allows for a high rate or speed of application.

After passing applying means 70, product containers 12 with utensils 22 applied thereto travel along flighted belt 54 to a cartoning means 90. conveniently, cartoning means 90 includes a Barrel-Cam Cartoner Model No. 9BCL150SS by ADCO of Sangor, California. Cartoning means 90 includes an erecting means 92 which erects flattened cartons 14 stored in a carton hopper 94 to form an opened carton 14 as shown in FIG. 1. Thereafter, a pusher means 96 inserts a respective product container 12 traveling along flighted belt 54 into an erected carton 14.

It should be appreciated that a third sensing means 98 in the form of an electric eye 100 is associated with cartoning means 90 and is also connected to control means 68. Third sensing means 98 senses the presence of successive containers 12 with respective utensils 22 applied thereto on flighted belt 54 approaching pusher means 96. When a container 12 is sensed, third sensing means 98 through control means 68 actuates erecting means 92 to erect a carton for each container thus sensed. After each carton 12 is inserted in an opened carton 14, a closing means 102 applies a hot melt adhesive to respective ends of carton 14 and closes and presses ends 36 to provide finished package 10.

It should also be appreciated that control means 68 includes a feedback means 104. Feedback means 104 is used to match a selected line speed of containers 12 on flighted belt 54 with a transferring speed of transferring means 52. Thus, as the line speed of applying means 70 and cartoning means 90 is increased, the transferring speed of transferring means 52 is similarly increased.

While the present invention has been described with respect to an exemplary embodiment thereof, it will be understood by those of ordinary skill in the art that variations and modifications can be effected within the scope and spirit of the invention.

I claim:

1. A continuous and automatic system for packing a container with a utensil applied thereto in a carton to form a finished package comprising:

a transferring means for the transferring containers travelling along an infeed conveyer to a flighted belt, said transferring means including a first sensing means for sensing the presence of a backlog of said containers at said transferring means and for enabling said transferring means when the backlog is sensed;

an applying means for applying a respective wrapped utensil to a surface of each said container passing along on said flighted belt, said applying means including a second sensing mean for sensing a presence of each successive said container on said flighted belt;

a feedback means for matching a selected line speed of said containers on said flighted belt with a transferring speed of said transferring means; and a cartoning means for placing each successive said container with a utensil applied thereto in a carton, and for closing said carton about said container to form the finished package.

2. A system for packing as claimed in claim 1 wherein said containers are rectangularly shaped in plan view; wherein said infeed conveyer and said flighted belt include respective portions thereof adjacent said transferring means which are parallel and laterally adjacent; and wherein said transferring means includes a stop against which said containers travelling along the infeed conveyer stack in a side-by-side alignment t form the backlog and a pusher member which rotates around said stop and which pushes a lead one of said containers of the backlog engaging the stop to the adjacent said portion of said flighted belt.

3. A system for packing as claimed in claim 1 wherein said applying means includes a gluing means for successively applying an adhesive to each said container sensed by said second sensing means on said flighted belt, a feeding/cutting means for feeding a continuous row of wrapped utensils and for successively cutting a leading wrapped utensil from the row, and a placing means for successively receiving the cut wrapped utensil and placing the wrapped utensil on the adhesive of successive said containers.

4. A system for packing as claimed in claim 3 wherein said applying means includes a first one and a second one of said feeding/cutting means associated respectively with a first one and a second one of said placing means whereby said first and second placing means place an associated said wrapped utensil on alternate said containers passing thereby on said flighted belt.

5. A system for packing as claimed in claim 1 wherein said cartoning means includes an erecting means having a carton hopper containing flat cartons therein for erecting an opened carton, and a third sensing means for sensing the presence of successive said containers with respective said utensils applied thereto on said flighted belt approaching said cartoning means and for actuating said erecting means to erect a said carton for each successive said container sensed.

6. A system for packing as claimed in claim 5 wherein said cartoning means includes a pusher means for pushing successive said containers into respective successively presented erected cartons from said erecting means.

7. A system for packing as claimed in claim 6 wherein said cartoning means further includes a closing means for closing opposite ends of successive said cartons containing a said container and utensil.

8. A system for packing as claimed in claim 2 wherein said applying means includes a gluing means for successively applying an adhesive to each said container sensed by said second sensing means on said flighted belt, a feeding/cutting means for feeding a continuous row of wrapped utensils and for successively cuting a leading wrapped utensil from the row, and a placing means for successively receiving the cut wrapped utensil and placing the wrapped utensil on the adhesive of successive said containers.

9. A system for packing as claimed in claim 8 wherein said cartoning means includes an erecting means having a carton hopper containing flat cartons therein for erecting an opened carton, and a third sensing means for sensing the presence of successive said containers with respective said utensils applied thereto on said flighted belt approaching said cartoning means and for actuating said erecting means to erect a said carton for each successive said container sensed.

10. A continuous and automatic method for packing a container with a utensil applied thereto in a carton to form a finished package comprising the steps of:

transferring containers travelling along an infeed conveyor to a flighted belt, including the step of sensing the presence of a backlog of containers at a transferring means and enabling the transferring means when the backlog is sensed;

applying a respective wrapped utensil to a surface of each container passing along on the flighted belt, including the step of sensing a presence of each successive container on the flighted belt;

matching a selected line speed of the containers on the flighted belt with a transferring speed of the transferring means;

placing each successive container with a utensil applied thereto in a carton; and closing each carton about the container to form the finished package.

11. A method for packing as claimed in claim 10 wherein the containers are rectangularly shaped in plan view, wherein the infeed conveyor and flighted belt include respective portions thereof adjacent the transferring means which are parallel and laterally adjacent, and wherein the transferring means includes a stop against which the containers travelling along the infeed conveyor stack in a side-by-side alignment to form the backlog; and further including the step of pushing a lead one of the containers of the backlog engaging the stop to the adjacent portion of the flighted belt.

12. A method for packing as claimed in claim 10 wherein said applying step includes the successive applying of an adhesive to each container sensed on the flighted belt, feeding a continuous row of wrapped utensils to a cutting means, cutting a lead wrapped utensil from the row, and placing successive cut wrapped utensils on the adhesive of successive containers.

13. A method for packing as claimed in claim 10 wherein said placing step includes the steps of erecting of a carton from a hopper containing a plurality of flattened cartons with a erecting means, sensing the presence of successive containers with respective utensils applied thereto on the flighted belt approaching the erecting means, and actuating the erecting means to erect the carton for each successive container sensed.

14. A method for packing as claimed in claim 13 wherein said placing step further includes the step of pushing successive containers into respective successively presented erected cartons from the flighted belt.

15. A method for packing as claimed in claim 14 wherein said closing step includes the step of closing and gluing respective ends of each erected carton.

* * * * *